United States Patent [19]

Beckham

[11] Patent Number: 4,832,292

[45] Date of Patent: May 23, 1989

[54] METHOD AND APPARATUS FOR HOLDING A TRASH BAG

[76] Inventor: William T. Beckham, 186 Emerald Lake Rd., Columbia, S.C. 29209

[21] Appl. No.: 200,647

[22] Filed: May 31, 1988

[51] Int. Cl.[4] ..... B65B 67/04

[52] U.S. Cl. ..... 248/99; 248/95

[58] Field of Search ..... 248/99, 100, 101, 95, 248/97; 383/12, 33

[56] References Cited

U.S. PATENT DOCUMENTS

| | | | |
|---|---|---|---|
| 1,414,575 | 5/1922 | McCart . | |
| 2,384,709 | 9/1945 | Thoren | 270/65 |
| 3,180,384 | 4/1965 | Seifert | 150/1 |
| 3,218,014 | 11/1965 | Frazier | 248/101 |
| 3,659,891 | 5/1972 | Pettenon et al. | 294/19 R |
| 3,697,030 | 10/1972 | Schultz | 248/101 |
| 3,747,653 | 7/1973 | Ringer | 248/99 X |
| 3,754,785 | 8/1973 | Anderson | 294/19 R |
| 3,779,419 | 12/1973 | Heitz | 220/63 R |
| 3,893,649 | 7/1975 | Cornell et al. | 248/99 |
| 3,934,803 | 1/1976 | Paulus, Jr. | 248/99 |
| 4,006,928 | 2/1977 | Beugin | 294/1 R |
| 4,021,994 | 5/1977 | Mainprice | 53/390 |
| 4,052,764 | 10/1977 | Groff | 15/257.9 |
| 4,238,868 | 12/1980 | Sternberg | 15/257.4 |
| 4,268,081 | 5/1981 | Hawkinson | 294/55 |
| 4,470,627 | 9/1984 | Carroll et al. | 294/55 |
| 4,548,372 | 10/1985 | Lutzker | 248/99 |
| 4,550,440 | 10/1985 | Rico | 383/33 |
| 4,615,743 | 10/1986 | Bylenga | 248/99 X |
| 4,659,045 | 4/1987 | Flynn | 248/99 |
| 4,664,348 | 5/1987 | Corsaut, III et al. | 248/99 |
| 4,749,011 | 6/1988 | Rylander | 248/99 X |

*Primary Examiner*—Ramon O. Ramirez
*Attorney, Agent, or Firm*—Michael A. Mann

[57] ABSTRACT

In the preferred embodiment a one-piece injection molded apparatus for holding and facilitating the filling of a trash bag and method for use is disclosed. The apparatus has a perimeter for holding the bag open, a curved rim on one side of the perimeter for retaining the bag and for gripping when lifting the bag, and a flattened portion of the perimeter for engaging a surface. The flattened portion has a protruding lip opposite the curved rim for standing the apparatus upright and for acting as a receiving ramp for sweeping into the bag.

6 Claims, 2 Drawing Sheets

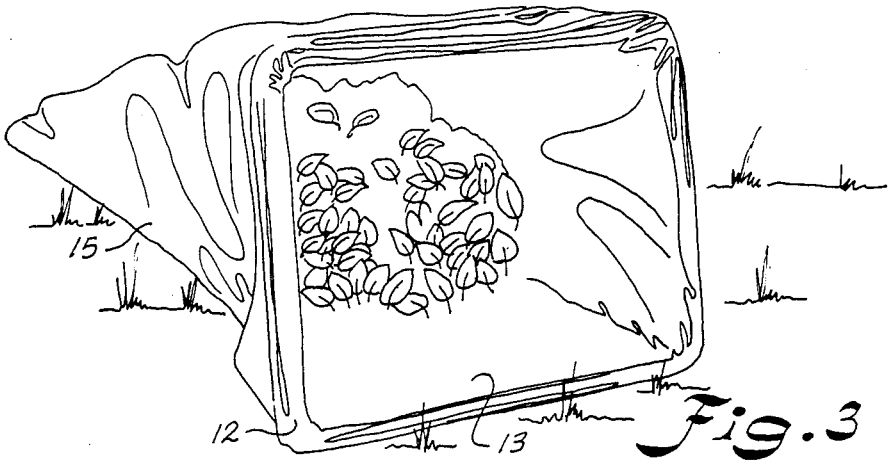
Fig. 3
Fig. 4
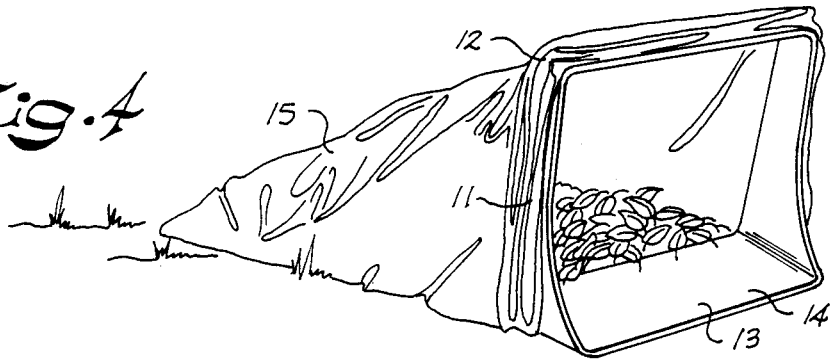
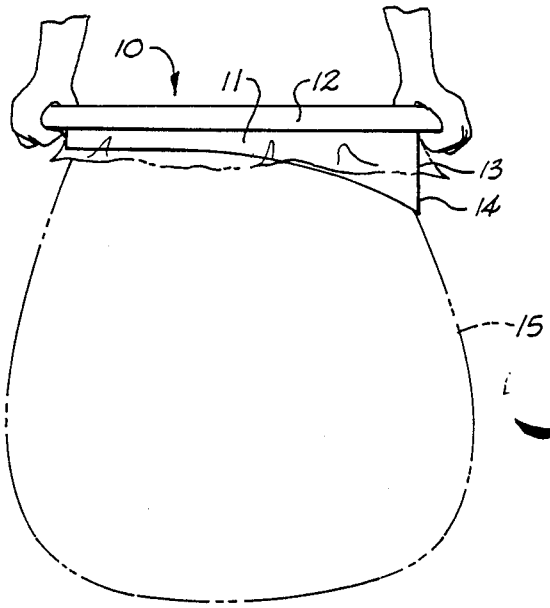
Fig. 5

METHOD AND APPARATUS FOR HOLDING A TRASH BAG

BACKGROUND OF THE INVENTION

The present invention relates to trash bag holders. More specifically, the present invention relates to one-piece apparatuses for holding the mouth of a trash bag open to facilitate the filling of the bag with leaves, grass, sweepings, and the like.

There are many trash bag holders in the prior art. Some are simple nested rims such as disclosed by Siefert in U.S. Pat. No. 3,180,384 or by Rico in U.S. Pat. No. 4,550,440. Others are free standing mechanical affairs such as Beugin's Lawn Bag Caddy (U.S. Pat. No. 4,006,928) or Paulus, Jr.'s Bag Distending and Supporting Apparatus (U.S. Pat. No. 3,934,803). Others hold a bag open for raking leaves, grass, sweepings and the like into the bag but will not hold a bag securely as it fills or cannot be used to lift a bag and move it from one place to another for continued filling, such as the Bag Holder of Corsaut, III et al. (U.S. Pat. No. 4,664,348).

Many prior art bag holders are overly elaborate or, if simple, only hold the bag in an open position. Many require some effort to set up or remove from a full bag.

It is an object of the present invention to provide a simple holder for trash bags. It is another object of the present invention to provide a one-piece holder for trash bags. It is yet a further object of the present invention to provide an inexpensive, injection moldable apparatus for holding trash bags. It is a still further object of the present invention to provide a holder that can be used to lift trash bags. It is another object of the invention to provide a trash bag holder that assists, by its features the filling of a trash bag.

SUMMARY OF THE INVENTION

These and other objections in the prior art are overcome and the objects of the present invention achieved by an apparatus comprising a one-piece holder for trash bags of the type commonly used for leaves, grass, sweepings and the like and a method for use. Specifically, the apparatus comprises a flat, thin perimeter of material, preferably plastic just large enough to fit over the mouth of the trash bag.

One one side of the perimeter has an outwardly curving rim to retain the bag and act as a handle for lifting the trash bag, with the underside of the curved rim receiving the fingers of the lifter. A portion of the apparatus perimeter is flattened thereby allowing the apparatus to stand on a generally flat surface when theflattened portion engages the surface.

The flattened portion has a lip protruding from the side opposite the curved rim for balancing the standing apparatus in a nearly upright, vertical position. Additionally, the protruding lip may act as a receiving ramp for sweeping into the bag.

The apparatus is used by pulling the opening of the bag through the perimeter from the side having the protruding lip to the side having the curved rim, then pulling the bag opening outwardly and over the curved rim. The perimeter is sized to just fit over the bag so that, when the mouth of the bag is pulled outward and over the curved rim, a secure fit between trash bag and apparatus is obtained. The fit allows a full bag to be lifted without sliding off or tearing when the apparatus is grasped and lifted by the curved rim.

Alternatively, the bag may be pulled over the curved rim from the side opposite the protruding lip so that, when standing on a surface, the exposed lip may act as a receiving ramp for sweepings.

DESCRIPTION OF THE DRAWINGS

FIG. 3 showing a perspective view of the apparatus with a trash bag oriented for normal use.

FIG. 4 showing a perspective view of the apparatus with a trashbag oriented for receiving sweepings.

FIG. 5 showing a perspective view of the apparatus used to lift a partially full trash bag.

DETAILED DESCRIPTION OF THE PREFERRED EMBODIMENT

The present invention is an apparatus for facilitating filling a trash bag with leaves, grass, sweepings and the like. The trash bag to be filled is a standard plastic variety having a large mouth or opening.

Figure 1:
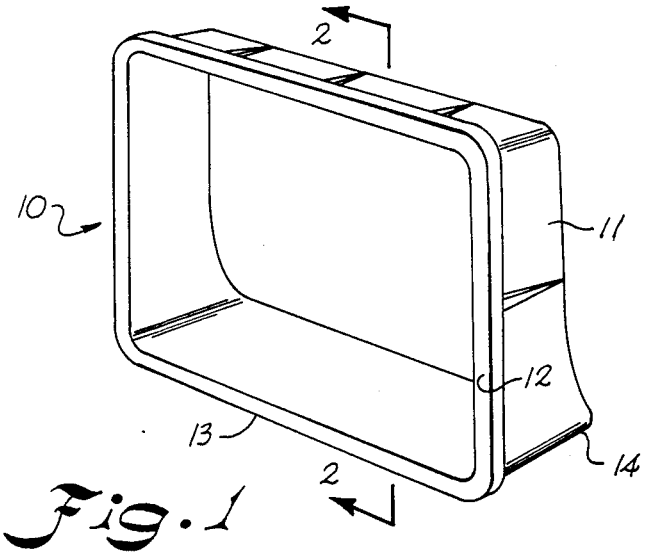
FIG. 1 showing a perspective view of the apparatus.

Referring to FIG. 1, the apparatus 10 comprises a perimeter 11 which is a thin, flat loop of material, preferably plastic. One side of the perimeter has an outwardly curving rim 12. A portion 13 of the perimeter 11 is flattened. The flattened portion 13 of the perimeter 11 has a protruding lip 14 opposite the curved rim 12 for balancing the perimeter 11 when the flattened portion 13 engages a surface. The flattened portion with the protruding lip will allow the apparatus 10 to stand, as best shown in FIG. 2, in a nearly vertical position.

The perimeter 11 just fits around the opening of the trash bag 15 when the trash bag 15 is pulled through the perimeter 11. Since the curved rim 12 on one side of the perimeter's flattened portion 13 raises that side and causes the perimeter 11 to lean back, the protruding lip 14 needs to be just long enough to balance the apparatus 10 when standing upright but not so long as to consume unnecessary material in fabrication or occupy extra space when stored, for example, on a wall in a garage.

Figure 2:
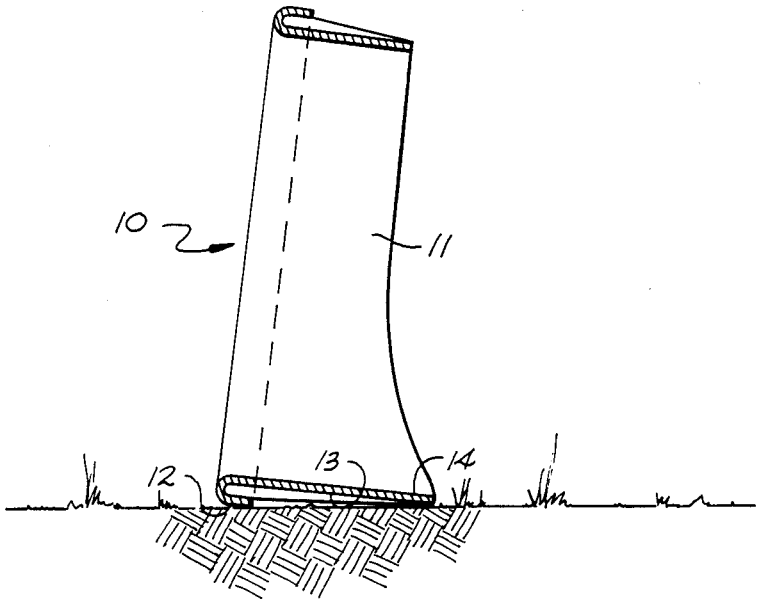
FIG. 2 showing a cross section of the apparatus along line 2—2 of FIG. 1.

The curved rim 12 is nearly a full semicircle, as seen best in FIG. 2, so that the opening of the bag 15, when stretched over the curved rim 12 is not torn by too small a curvature or too short and sharp a rim 12, but is held in place by the tension on a full or partially full trash bag 15 and by the frictional and electrostatic forces of the plastic-to-plastic interface of trash bag 15 and curved rim 12. The curved rim 12 additionally acts as a handle for gripping the apparatus 10 and lifting the bag 15 for moving.

The apparatus 10 is preferably made of plastic and can easily be injection molded.

It will be seen from the description that there are serveral variations in the elements of the apparatus and their composition that are possible without departing from the spirit and scope of the present invention.

I claim:

1. An apparatus for holding and for facilitating filling a trash bag with leaves, grass, sweepings and the like which trash bag has an opening, said apparatus comprising:

a perimeter just fitting around the opening of said trash bag having a first side and a second side;

an outwardly curving rim on said first side over which said trash bag opening is stretched whereby said trash bag is retained and lifted said outwardly curving rim receiving the fingers for lifting said trash bag;

a flattened portion of said perimeter for standing said perimeter in a nearly vertical position on a surface, said outwardly curving rim raising said first side of said flattened portion of said perimeter so that said perimeter leans.

2. The apparatus of claim 1 wherein the apparatus is made in one piece of injection molded plastic.

3. The apparatus of claim 1 wherein said perimeter is thin and said flattened portion has a short lip protruding from said second side said lip balancing said perimeter in a nearly vertical position.

4. The apparatus of claim 3 wherein said protruding lip is long enough so that it can be conveniently used as a ramp for sweeping into said trash bag when said trash bag is stretched over said outwardly curving rim and said perimeter, said outwardly curving rim and said perimeter just fitting inside said opening of said trash bag.

5. A method for using an apparatus for facilitating filling a trash bag with leaves, grass, sweepings and the like, which trash bag has an opening, said apparatus having a perimeter just fitting around the opening of said trash bag, said perimeter having a first side and a second side;

an outwardly curving rim on said first side for retaining and lifting said trash bag; and a flattened portion of said perimeter for standing said perimeter in a nearly vertical position on a surface, said outwardly curving rim raising said first side of said flattened portion of said perimeter so that said perimeter leans, said flattened portion having a lip protruding from said second side to balance said perimeter, which method comprises the steps of fitting said perimeter over the opening of said trash bag from said second side to said first side;

pulling the opening of said trash bag outward and over said outwardly curving rim;

standing said apparatus on said surface said flattened portion down and said perimeter leaning back, engaging said surface;

filling said trash bag; and lifting said perimeter, having said filled trash bag thereon, by said outwardly curving rim, said outwardly curving rim receiving the fingers so that said trash bag may be moved without sliding off said apparatus or tearing.

6. A method for using an apparatus for facilitating filling a trash bag with leaves, grass, sweepings and the like, which trash bag has an opening, said apparatus having a perimeter just fitting around the opening of said trash bag, said perimeter having a first side and a second side;

an outwardly curving rim on said first side for retaining and lifting said trash bag; and a flattened portion of said perimeter for standing said perimeter in a nearly vertical position on a surface, said outwardly curving rim raising said first side of said flattened portion of said perimeter so that said perimeter leans, said flattened portion having a lip protruding from said second side to balance said leaning perimeter, which method comprises the steps of pulling the opening of said trash bag over said outwardly curving rim from said first side to said second side;

standing said apparatus on said surface in a nearly vertical position, said perimeter leaning forward, said flattened portion engaging said surface and said protruding lip facing away from said trash bag; and sweeping into said trash bag over said protruding lip.

* * * * *